US011441219B2

(12) United States Patent
Kim et al.

(10) Patent No.: US 11,441,219 B2
(45) Date of Patent: Sep. 13, 2022

(54) BLACK PLATED STEEL SHEET AND MANUFACTURING METHOD THEREFOR

(71) Applicant: RESEARCH INSTITUTE OF INDUSTRIAL SCIENCE & TECHNOLOGY, Pohang-si (KR)

(72) Inventors: Hye Jeong Kim, Pohang-si (KR); Gab Sik Byun, Pohang-si (KR); Kyung Hwang Lee, Incheon (KR); Mi Seon Choi, Pohang-si (KR)

(73) Assignee: RESEARCH INSTITUTE OF INDUSTRIAL SCIENCE & TECHNOLOGY, Pohang-si (KR)

( * ) Notice: Subject to any disclaimer, the term of this patent is extended or adjusted under 35 U.S.C. 154(b) by 516 days.

(21) Appl. No.: 16/448,017

(22) Filed: Jun. 21, 2019

(65) Prior Publication Data

US 2020/0002800 A1 Jan. 2, 2020

Related U.S. Application Data

(63) Continuation-in-part of application No. PCT/KR2017/014568, filed on Dec. 12, 2017.

(30) Foreign Application Priority Data

Dec. 21, 2016 (KR) ..... 10-2016-0175671
Dec. 21, 2016 (KR) ..... 10-2016-0175692

(51) Int. Cl.

| | |
|---|---|
| ***C23C 8/10*** | (2006.01) |
| ***C23C 8/12*** | (2006.01) |
| ***C22C 18/04*** | (2006.01) |
| ***C23C 2/06*** | (2006.01) |
| ***C23C 2/28*** | (2006.01) |
| ***C23C 2/40*** | (2006.01) |
| ***C23C 8/16*** | (2006.01) |

(52) U.S. Cl.

CPC ..... *C23C 8/12* (2013.01); *C22C 18/04* (2013.01); *C23C 2/06* (2013.01); *C23C 2/28* (2013.01); *C23C 2/40* (2013.01); *C23C 8/16* (2013.01)

(58) Field of Classification Search

CPC ..... C23C 8/10–18

See application file for complete search history.

(56) References Cited

U.S. PATENT DOCUMENTS

2015/0083276 A1* 3/2015 Nakano ..... C23C 22/05 148/284

FOREIGN PATENT DOCUMENTS

| | | |
|---|---|---|
| JP | 10-331144 | 12/1998 |
| JP | 2001-279414 | 10/2001 |
| JP | 2004-256838 | 9/2004 |
| JP | 2006-028539 | 2/2006 |
| JP | 2008-261024 | 10/2008 |
| JP | 2013-023768 | 2/2013 |
| KR | 10-2014-0058296 | 5/2014 |
| KR | 10-2014-0128464 | 11/2014 |

(Continued)

OTHER PUBLICATIONS

WIPO, International Search Report of PCT/KR2017/014568 dated Apr. 26, 2018.

*Primary Examiner* — Lois L Zheng

(74) *Attorney, Agent, or Firm* — Lex IP Meister, PLLC

(57) ABSTRACT

Embodiments of the present invention provide a technique for forming a film having a high added value appearance quality and excellent hardness on the surface of a steel sheet in a short time.

12 Claims, 6 Drawing Sheets

(56) References Cited

FOREIGN PATENT DOCUMENTS

| | | |
|---|---|---|
| KR | 10-2015-0002668 | 1/2015 |
| KR | 10-2015-0002669 | 1/2015 |

* cited by examiner

【Fig. 1】
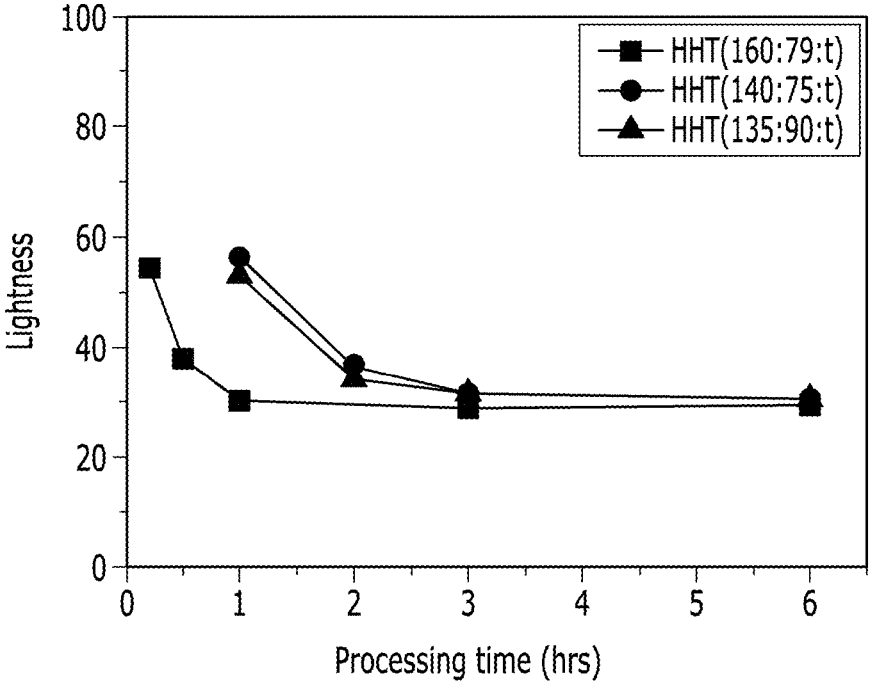

【Fig. 2】
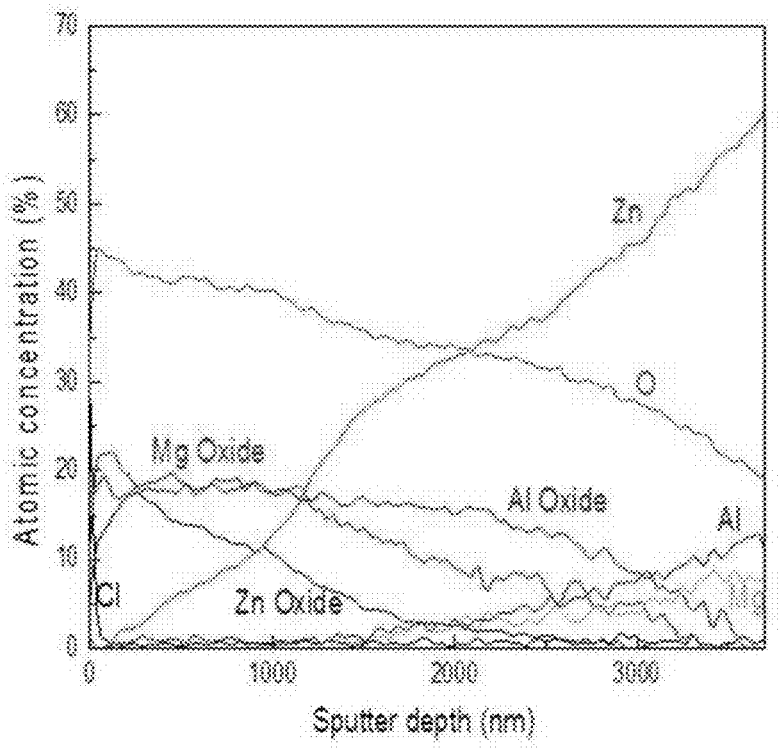

【Fig. 3】
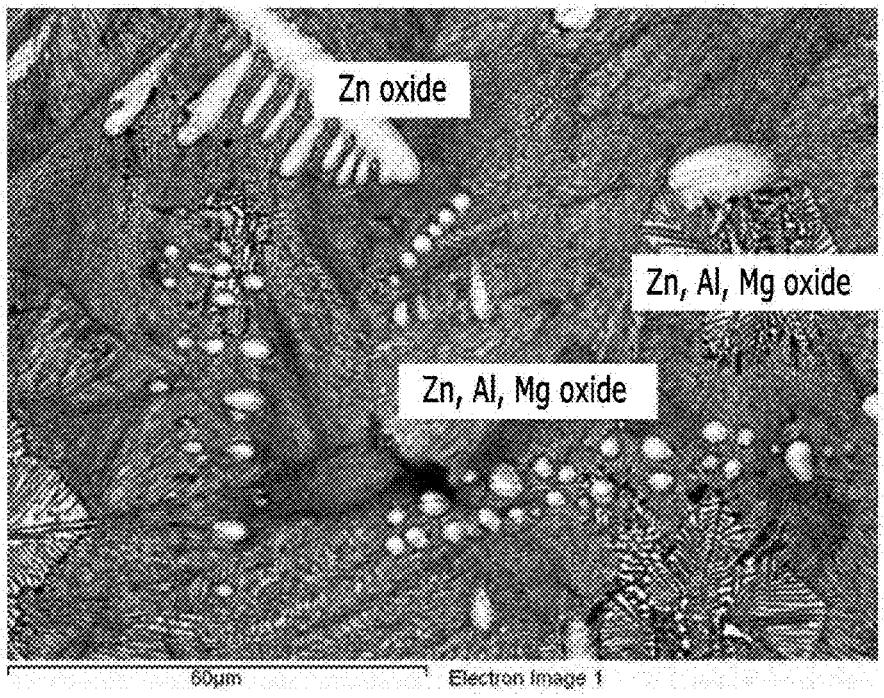

【Fig. 4】
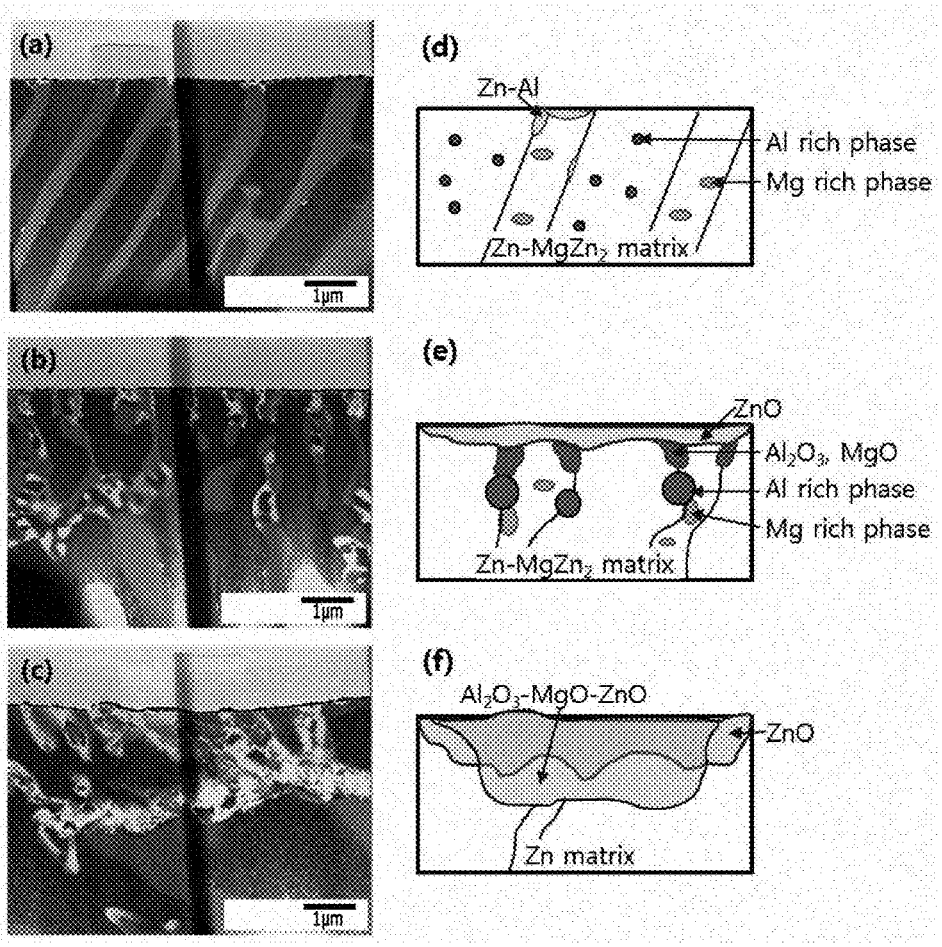

【Fig. 5】
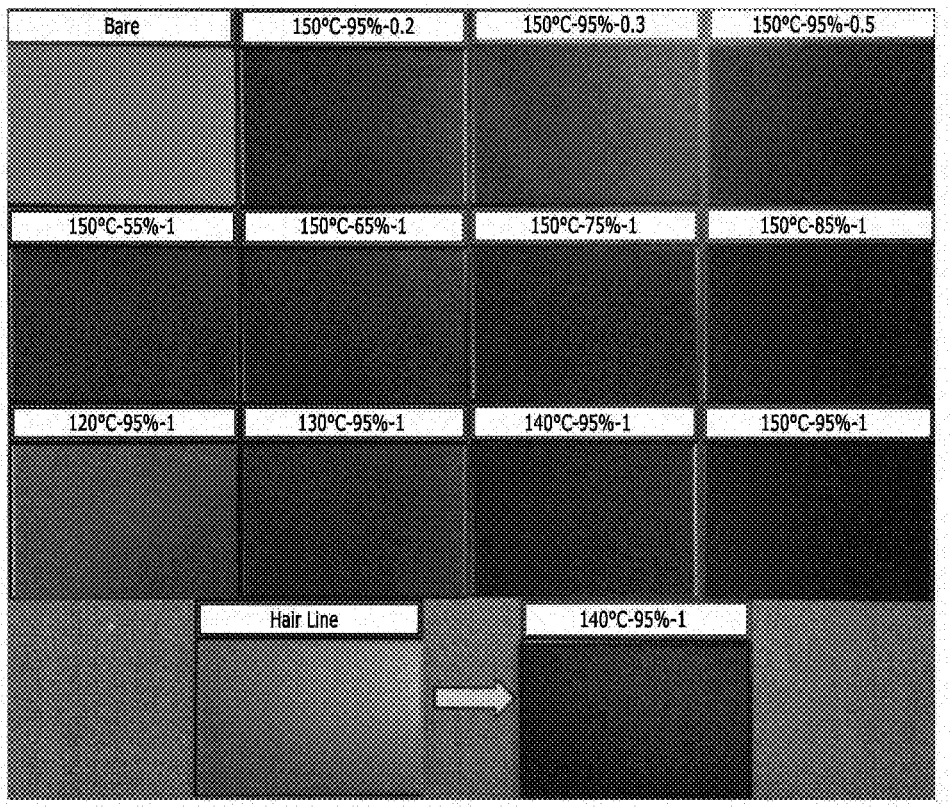

【Fig. 6】
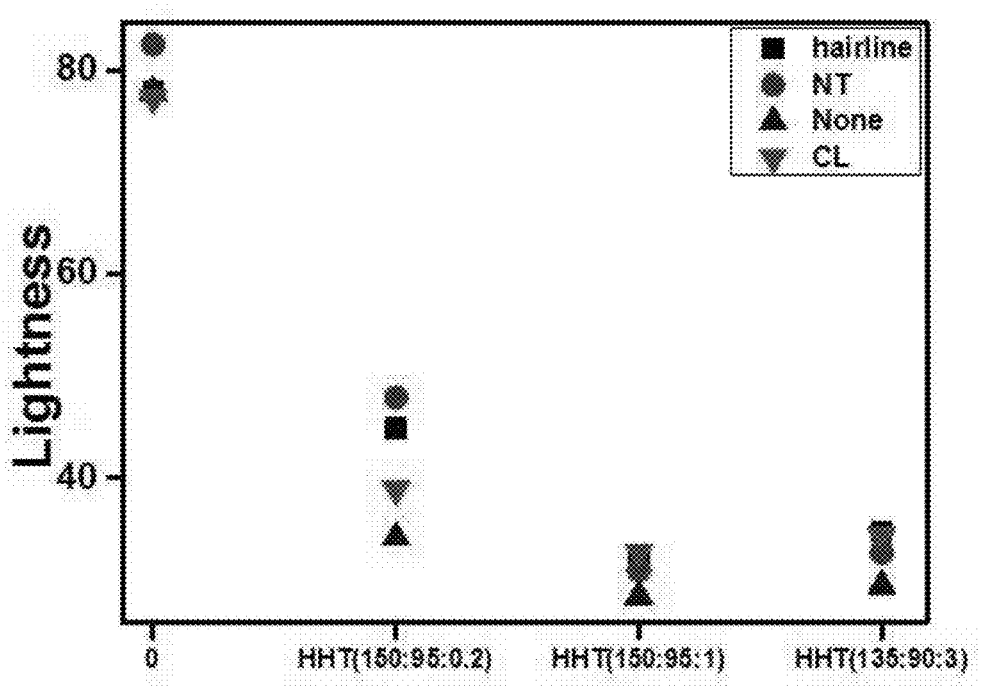

BLACK PLATED STEEL SHEET AND MANUFACTURING METHOD THEREFOR

TECHNICAL FIELD

It relates to a black plated steel sheet and a manufacturing method thereof.

BACKGROUND

In general, iron-based steel sheet is one of the materials used in the manufacture of automotive parts, such as high mechanical strength and high dimensional stability. In recent years, steel sheets having high added value appearance quality and excellent hardness are also required in the fields of building materials, home appliances, automobiles, and the like.

In particular, the Al—Mg—Zn ternary plated steel sheet reduces the amount of Zn alloy which is depleted element, and can produce a high corrosion resistant steel sheet with a low thickness through Al and Mg. Specifically, compared to the binary-based galvanized steel sheet in which only Mg or Al is added to Zn, corrosion resistance is very excellent, and the current usage is continuously increasing. In this regard, a method of plating Zn or Zn-based alloys on the surface of a steel sheet is known. However, the plated steel sheet has a problem in that the color of the plating layer is not uniform or the strength is weak due to various alloying elements of the plating layer, so that the appearance quality is not uniform.

In order to solve this problem and make a steel sheet having excellent heat dissipation, the conventional JP1997-0143679 introduces a method of blackening the steel sheet through $Mg(OH)_2$ and ZnO by humidifying heat treatment of a binary coated steel sheet containing Zn and Mg. However, this is a binary plated steel sheet, and the processing temperature is low, so that there is a disadvantage that the processing time is very long.

Problem to Solve

Embodiments of the present invention provide a technique for forming a film having a high added value appearance quality and excellent hardness on the surface of a steel sheet in a short time.

Solution of Problem

In one embodiment of the present invention, a black plated steel sheet comprising: a steel sheet; and a film located on the surface of the steel sheet; is provided.

Wherein, the film comprises: a Zn matrix; and ZnO, $Al_2O_3$, and MgO mixed in the Zn matrix, and brightness L at the surface of the film is 60 or less (except 0). More specifically, the brightness L value is 40 or less (except 0).

Specifically, the thickness of the film may be 2 to 4 μm.

The ZnO may be present up to a depth of 1.5 to 3.5 μm from the surface of the film.

The MgO and $Al_2O_3$ may each be present up to a depth of 3 to 4 μm from the surface of the film.

The film may further include Al and Mg. In this case, the amount of the Al and Mg is, respectively, gradually increased from the surface of the film from 1.5 to 2.5 μm depth to the interface of the steel sheet.

In the film of the final steel sheet, ZnO, $Al_2O_3$, and MgO are each present within 20% by weight (except 0% by weight), and the balance may be present as a hydrate of ZnO, a hydrate of $Al_2O_3$, a hydrate of MgO, or a mixture thereof.

The steel sheet may be a ternary plated steel sheet including Zn, Al, and Mg.

In another embodiment of the present invention, a method for producing black plated steel sheet comprising: an air removing step of removing some or all of the air inside a sealed container; an oxygen input step of injecting oxygen ($O_2$) into the sealed container after the air removing step; and a humidifying heat treatment step of Zn plated steel sheet or Zn alloy-based plated steel sheet in the sealed container after the oxygen input step; is provided.

Wherein, in the humidifying heat treatment step, a brightness L value on the surface of the plated steel sheet is controlled to 60 or less (except 0). More specifically, the brightness L value is controlled to 40 or less (except 0).

Wherein, the air removing step is to remove all the air in the sealed container until the pressure inside the sealed container reaches 0 bar.

Wherein, the oxygen input step is to inject oxygen into the sealed container through the air removing step until the pressure in the sealed container reaches 0.5 to 1.5 bar.

The humidifying treatment step may be performed at a constant humidity in a range of 50 to 100 RH % or less in a temperature range of 100° C. or more and 160° C. or less. In addition, the humidifying heat treatment step may be performed within 2 hours (except 0 hours), specifically 0.5 to 2 hours.

The humidifying heat treatment step may be carried out in an oxygen concentration of 14 to 50% by volume. More specifically, it may be carried out in the range of 14 to 35% by volume. More specifically, it may be performed in the range of 20 to 35% by volume.

Meanwhile, the Zn alloy-based plated steel sheet may be a ternary plated steel sheet of Al, Mg, and Zn. Specifically, a plating layer comprising Al 1.0 to 22.0% by mass, Mg 1.3 to 10.0% by mass, remainder Zn and other unavoidable impurities may be formed on the surface of the magnesium-based or magnesium alloy-based steel sheet.

In the humidifying treatment step, the plating layer is oxidized, and then converted to a film comprising Zn matrix; and ZnO, $Al_2O_3$, and MgO mixed in the Zn matrix.

Effect

According to one embodiment of the invention, a film having a high added value appearance quality and excellent hardness can be formed on the surface of the steel sheet in a short time.

Specifically, it is possible to provide an Al—Mg—Zn ternary black plated steel sheet having excellent surface quality. More specifically, it is possible to provide a black plated steel sheet having a uniform surface and high added value through the humidifying treatment. More specifically, by using a water vapor oxidation method, a dense oxide film may be formed on the surface of the steel sheet within a short time. From this, the steel sheet with high hardness can be provided.

BRIEF DESCRIPTION OF DRAWINGS

FIG. 1 is a graph of the surface brightness L value according to the conditions in which the plated steel sheet is subjected to the humidifying heat treatment in Examples 1 to 3 of the present invention.

FIG. 2 shows the distribution of the material for each film thickness of Example 4 of the present invention.

FIG. 3 shows the results of EDS analysis on the surface of Example 4 of the present invention.

FIG. 4 is a FIB-TEM and schematic diagram of the film before and after the humidifying heat treatment of Examples 4 and 5 of the present invention.

FIG. 5 is an appearance evaluation result according to the extended humidifying heat treatment conditions from Examples 1 to 5 of the present invention.

FIG. 6 is an appearance evaluation result according to the pretreatment conditions and the constant humidifying heat treatment conditions of the plated steel sheet expanded from Examples 1 to 5 of the present invention.

DETAILED DESCRIPTION OF THE INVENTION

Advantages and features of the present invention and methods for achieving them will be apparent with reference to the embodiments described below in detail. However, the present invention is not limited to the embodiments disclosed below, but may be implemented in various forms. These embodiments are provided to fully inform the scope of the invention to those skilled in the art. The invention is only defined by the scope of the claims.

In one embodiment of the present invention, a black plated steel sheet comprising: a steel sheet; and a film located on the surface of the steel sheet; is provided. Wherein, the film comprises: a Zn matrix; and ZnO, $Al_2O_3$, and MgO mixed in the Zn matrix, and brightness L at the surface of the film is 60 or less (except 0).

In another embodiment of the present invention, a method for producing black plated steel sheet comprising: an air removing step of removing some or all of the air inside a sealed container; an oxygen input step of injecting oxygen ($O_2$) into the sealed container after the air removing step; and a humidifying heat treatment step of Zn plated steel sheet or Zn alloy-based plated steel sheet in the sealed container after the oxygen input step; is provided. Wherein, in the humidifying heat treatment step, a brightness L value on the surface of the plated steel sheet is controlled to 60 or less (except 0).

Hereinafter, a method of manufacturing a black plated steel sheet and thus obtained black plated steel sheet provided by embodiments of the present invention will be described in detail.

In general, as described above, in recent years, in the fields of building materials, home appliances, automobiles, and the like, steel sheets having high added value of appearance quality and excellent hardness are required.

In this regard, a method of plating Zn or a Zn-based alloy on the surface of a steel sheet is known, but it is known that the appearance quality is not good, such as the surface is not uniform.

However, according to one embodiment of the present invention, when the Zn plated steel sheet or Zn alloy-based plated steel sheet is heat-treated in a sealed container in which humidity is constantly controlled, the plating layer may be oxidized and then converted into a film having a uniform surface.

Specifically, the plated steel sheet may be a Zn alloy-based plated steel sheet, for example, may be a ternary plated steel sheet of Al, Mg, and Zn. Accordingly, the film can include Zn matrix; and ZnO, $Al_2O_3$, and MgO mixed in the Zn matrix.

In particular, according to an embodiment of the present invention, when the heat-humidity heat treatment in the state of raising the oxygen contents in the sealed container, it is possible to form the film in a short time. Specifically, when oxygen ($O_2$) is added after removing part or all of the air in the sealed container, the brightness L value is 60 or less (except 0) in a short time on entire surface of film due to the high oxygen concentration.

More specifically, it can reach 40 or less (except 0).

In the specification, the brightness L value means a lightness value of a color difference meter measured with a color difference meter. The lower the brightness L* value, the higher the degree of blackness of the film. More specifically, in the case of black, the brightness L* value is represented by 0, and in the case of white, the L* value is represented by 100.

Accordingly, the surface color of the film is uniformly blackened, so that the film can have a high added value appearance quality. In addition, the internal structure of the film can be dense, it can have a high hardness.

Specifically, the air removing step may be to remove some or all of the air in the sealed container until the pressure inside the sealed container reaches 0 bar.

If the pressure inside the sealed container after removing the air step exceeds the above range, even if oxygen is introduced in a subsequent step, the concentration is not sufficient. Also, the time to reach the brightness L value of 60 or less (except 0) may be delayed. In addition, the surface color may not be uniformly blackened, and the internal structure of the film may not be formed densely.

The oxygen input step may be to inject oxygen into the sealed container through the air removing step until the pressure in the sealed container reaches 0.5 to 1.5 bar.

When the pressure inside the sealed container after the oxygen input step is less than the above range, the oxygen concentration is not sufficient, the time to reach the brightness L value of 60 or less (except 0) may be delayed. In addition, the surface color may not be uniformly blackened, and the internal tissue of the film may not be densely formed.

The humidifying treatment step may be performed at a constant humidity in a range of 50 to 100 RH % or less in a temperature range of 100° C. or more and 160° C. or less.

In addition, the humidifying heat treatment step may be performed within 2 hours (except 0 hours). Specifically, it may be performed for 0.5 to 2 hours.

The humidifying heat treatment step may be performed at an oxygen concentration of 14 to 50% by volume. If the oxygen concentration is too low, the process pressure is high in the vessel so that a process yield is poor. In addition, if the oxygen concentration is too high, the rate of blackening is very slow. Specifically, the oxygen concentration may be performed in the range of 14 to 35% by volume. In addition to oxygen, some elements in the atmosphere may be included. Under such internal gas atmosphere, temperature, and humidity conditions, the plating layer is oxidized and then converted to the film including a Zn matrix; and ZnO, $Al_2O_3$, and MgO mixed in the Zn matrix.

However, the time required for the L value of the surface to reach 60 or less may be different within the above range. Specifically, the higher the humidifying heat treatment temperature, the higher the humidity, the shorter the time required for the L value of the surface to reach 60 or less.

More specifically, the thickness of the film may be 2 to 4 μm. If the thickness of the film is too thick, chipping of the film may occur. Therefore, the thickness of the film may be in the above range.

The Zn matrix may be distributed over the entire region of the film. However, in the Zn matrix, ZnO, $Al_2O_3$, and MgO may exist to a certain depth from the surface of the film, respectively.

Specifically, the ZnO may be present up to a depth of 1.5 to 3.5 μm from the surface of the film. In addition, the MgO and $Al_2O_3$ may be present up to a depth of 3 to 4 μm from the surface of the plating layer, respectively. That is, the MgO and $Al_2O_3$ may be present up to a region deeper than the ZnO, respectively.

On the other hand, since the film is derived from a Zn-based plating layer containing Al and Mg, it may further include Al and Mg. In this case, the amounts of Al and Mg may gradually increase from a depth of 1.5 to 2.5 μm of the surface of the film to the interface of the steel sheet.

In the film of the final steel sheet, ZnO, $Al_2O_3$, and MgO are each present within 20% by weight (except 0% by weight), and the balance is present as a hydrate of ZnO, a hydrate of $Al_2O_3$, a hydrate of MgO, or a mixture thereof.

On the other hand, when the steel sheet is a ternary plated steel sheet of Al, Mg, and Zn, the surface the plated steel sheet includes a plating layer comprising Al 1.0 to 22.0 wt %, Mg 1.3 to 10.0 wt %, the balance containing Zn and other unavoidable impurities.

The plating layer internal material (ie, steel plate) may be a ternary plated steel sheet of Al, Mg, and Zn.

Hereinafter, examples of the present invention, comparative examples, and evaluation examples thereof will be described. However, the following embodiments are only a part of the embodiments of the present invention, whereby the scope of the present invention is not limited.

Example 1 (Humidifying Heat Treatment Condition: Temperature 160° C., Humidity 79 RH %)

(1) Plated Steel Sheet Preparation

A ternary plated steel sheet having a Zn-based plated layer including molten Al and Mg formed thereon was used. Specifically, the plated steel sheet is a ternary galvanized steel sheet containing Zn, Al, and Mg.

(2) Control of the Gas Atmosphere Inside the Sealed Container Before the Humidifying Heat Treatment The sealed container was prepared, the air was removed until it reached 0 bar using a pump, and oxygen was added until it reached 1 bar using another pump.

(3) Humidifying Heat Treatment

The plated steel sheet was placed in a sealed container in which the internal gas atmosphere was formed. The sealed container was heat-treated at a temperature of 160° C. while maintaining a constant humidity of 79 RH % in a closed state.

In accordance with the humidifying heat treatment, as the plating layer of the plated steel sheet was oxidized, the surface color was converted into a blackened film.

Example 2 (Humidifying Heat Treatment Conditions: Temperature 140° C., Humidity 75 RH %)

The surface of the plated steel sheet was blackened in the same manner as in Example 1, except that the temperature was changed to a temperature of 140° C. and a humidity of 75 RH % at constant humidity heat treatment conditions.

Example 3 (Humidifying Heat Treatment Condition: Temperature 135° C., Humidity 90 RH %)

The surface of the plated steel sheet was blackened in the same manner as in Example 1, except that the temperature was changed to a temperature of 135° C. and a humidity of 90 RH % under constant humidity heat treatment.

Example 4 (Humidifying Heat Treatment Condition: Temperature 150° C., Humidity 95 RH %)

The surface of the plated steel sheet was blackened in the same manner as in Example 1 except that the temperature was changed to a temperature of 150° C. and a humidity of 95 RH % at constant humidity heat treatment, and then treated for 1 hour.

Example 5 (Humidifying Heat Treatment Condition: Temperature 150° C., Humidity 95 RH %)

The surface of the plated steel sheet was blackened in the same manner as in Example 1, except that the temperature was changed to a temperature of 150° C. and a humidity of 95 RH % under a constant humidity heat treatment condition, and then treated for 0.2 hours.

Evaluation Example 1

For each of Examples 1 to 3, the brightness L value of the formed film was measured and shown in FIG. 1 according to the humidifying heat treatment time.

According to FIG. 1, it can be confirmed that L values of the surfaces reached within 40% in 2 hours in both Examples 1 to 3 as the humidity and heat treatment were performed in a state where the oxygen concentration inside the sealed container was formed high.

In addition, in Examples 1 to 3, when the L value of the surface reaches a specific value of 40% or less, it can be confirmed that it is no longer lowered. Specifically, the L value in the finally obtained black plated steel sheet converges to 25 to 30.

On the other hand, the time taken for the L value of the surface to reach 40% or less is different in Examples 1 to 3, which is due to the difference in the heating temperature and the humidity. Specifically, the higher the heat temperature, the higher the humidity, the shorter the time required for the L value of the surface to reach 40% or less.

Evaluation Example 2

FIG. 2 shows a distribution diagram of substances according to film thickness in Example 4.

In FIG. 2, the Zn oxide is present up to a depth of about 2 μm from the surface, and the amount of Zn metal increases as it is deeper from the surface. Each oxide of Al and Mg is present up to a depth of about 3.5 μm from the surface, it can be seen that each amount of metal of Al and Mg is increased at the deeper from a depth of about 2 μm from the surface. In addition, it can be seen that the depth at which each oxide of Al and Mg exists is deeper than that of Zn oxide. The oxide as a whole appears to be distributed from the surface to a depth of about 3-4 μm.

FIG. 3 shows the results of EDS analysis on the surface of Example 4.

In FIG. 3, it is shown that the zone where the Zn oxide is present and the zone where each of the oxides of Zn, Al, and Mg present are mixed.

FIG. 4 is a FIB-TEM and a schematic view of the film according to the humidifying heat treatment time of Examples 4 and 5.

In FIG. 4, a and d are properties before the humidifying heat treatment, b and e are properties after the humidifying heat treatment at 150° C., 95 RH %, and 0.2 hours (Example 5), and c and f are properties after the humidifying heat treatment at 150° C., 95 RH %, and 1 hour (Example 4). Accordingly, it is possible to grasp the influence of the heat treatment time under the same temperature and humidity conditions.

Specifically, before the humidifying heat treatment, it is found that the Al rich phase and the Mg rich phase are alternately included in the Zn—$MgZn_2$ matrix, and a Zn—Al secondary phase is formed at the interface of the Al and Mg rich phases.

In addition, when the humidifying treatment was performed for 0.2 hours, the boundary between the Al rich phase and the Mg rich phase disappeared, and it can be confirmed that ZnO began to be formed from the surface. In addition, it can be seen that $Al_2O_3M$ and MgO are partially formed.

After 1 hour of the humidifying heat treatment, it can be seen that the zone where the Zn oxide exists in the Zn matrix and the zone where the respective oxides of Zn, Al, and Mg exist are mixed.

Evaluation Example 2

Specifically, expanding from Examples 1 to 5, the effect of the humidifying treatment condition was confirmed. Specifically, the humidifying heat treatment in the temperature, humidity, and time conditions shown in FIG. 5, and the rest was the same as in Example 1.

In FIG. 5, it can be seen that the surface characteristics (film thickness and color) of the black plated steel sheets vary with temperature, humidity, and time.

More specifically, the higher the heat treatment temperature at the same humidity and time conditions, the higher the humidity at the same heat treatment temperature and time conditions, or the longer the heat treatment at the same temperature and humidity conditions, the deeper the degree of blackening and the thicker the film thickness.

Therefore, it can be seen that the film thickness and color can be diversified by controlling the humidifying heat treatment condition.

Evaluation Example 3

Expanded from Examples 1 to 5, the influence of the pre-treatment conditions and the humidifying heat treatment conditions of the plated steel sheet was confirmed.

Specifically, for each plated steel sheet surface treated with chromate (CL), inorganic material (NT), and hairline; and uncoated plated steel sheet; the temperature, the pressure inside the container, humidity, oxygen concentration and time shown in FIG. 6 and Table 1 was used as conditions of humidifying heat treatment, and the remainder was the same as in Example 1.

TABLE 1

| Temperature (° C.) | Pressure inside vessel (bar) | Humidity (RH %) | Oxygen Concentration (% Volume) | Hours (hr) | Brightness L Value |
|---|---|---|---|---|---|
| | | bare | | | 77 |
| 150 | 4.6 | 95 | 22 | 0.2 | 54 |
| 150 | 4.6 | 95 | 22 | 0.3 | 37 |
| 150 | 4.6 | 95 | 22 | 0.5 | 32 |

TABLE 1-continued

| Temperature (° C.) | Pressure inside vessel (bar) | Humidity (RH %) | Oxygen Concentration (% Volume) | Hours (hr) | Brightness L Value |
|---|---|---|---|---|---|
| 150 | 4.6 | 55 | 27 | 1 | 55 |
| 150 | 4.6 | 65 | 25 | 1 | 48 |
| 150 | 4.6 | 75 | 24 | 1 | 37 |
| 150 | 4.6 | 85 | 23 | 1 | 31 |
| 120 | 3 | 95 | 33 | 1 | 60 |
| 130 | 3.4 | 95 | 29 | 1 | 52 |
| 140 | 3.8 | 95 | 26 | 1 | 48 |
| 150 | 4.6 | 95 | 22 | 1 | 28 |

In FIG. 6 and Table 1, it can be seen that the surface L value of the obtained black plated steel sheet is changed according to the pretreatment conditions and the constant humidifying heat treatment conditions of the plated steel sheet.

Therefore, it can be seen that color can be diversified by controlling the pretreatment condition and the humidity treatment condition of the plated steel sheet.

Although the embodiments of the present invention have been described above, it will be understood by those skilled in the art that the present invention may be implemented in other specific forms without changing the technical spirit or essential features thereof.

Therefore, it should be understood that the embodiments described above are exemplary in all respects and not restrictive. The scope of the present invention is shown by the following claims rather than the detailed description, and all changes or modifications derived from the meaning and scope of the claims and their equivalents should be construed as being included in the scope of the present invention.

The invention claimed is:

1. A method for producing black plated steel sheet comprising:

an air removing step of removing some or all of the air inside a sealed container;

an oxygen input step of injecting oxygen (O2) into the sealed container after the air removing step; and a humidifying heat treatment step of Zn plated steel sheet or Zn alloy-based plated steel sheet in the sealed container after the oxygen input step;

wherein, in the humidifying heat treatment step, a brightness L value on the surface of the plated steel sheet is controlled to 60 or less (except 0), wherein, the air removing step is to remove all the air in the sealed container until the pressure inside the sealed container reaches 0 bar.

2. The method of claim 1, wherein, the oxygen input step is to inject oxygen into the sealed container through the air removing step until the pressure in the sealed container reaches 0.5 to 1.5 bar.

3. The method of claim 2, the humidifying heat treatment step is to be carried out in a temperature range of 100 to 160° C.

4. The method of claim 2, the humidifying heat treatment step is to be performed at a constant humidity, in the range of 50 to 100 RH %.

5. The method of claim 2, the humidifying heat treatment step is to be carried out in an oxygen concentration of 14 to 50% by volume.

6. The method of claim 5, the humidifying heat treatment step is to be carried out in an oxygen concentration of 14 to 35% by volume.

7. The method of claim 2, the humidifying heat treatment step is to be carried out within 2 hours (except 0 hours).

8. The method of claim 7, the humidifying heat treatment step is to be carried out for 0.5 to 2 hours.

9. The method of claim 1, the Zn alloy-based plated steel sheet is a ternary-based plated steel sheet of Al, Mg, and Zn.

10. The method of claim 9, the surface the Zn alloy-based plated steel sheet includes a plating layer comprising Al 1.0 to 22.0 wt %, Mg 1.3 to 10.0 wt %, the balance containing Zn and other unavoidable impurities.

11. The method of claim 10, wherein, in the humidifying heat treatment step, the plating layer is oxidized.

12. The method of claim 11, wherein, in the humidifying heat treatment step, the plating layer is oxidized, and then converted to a film comprising Zn matrix; and ZnO, $Al_2O_3$, and MgO mixed in the Zn matrix.

* * * * *